US009469038B2

(12) United States Patent
Iaccarino et al.

(10) Patent No.: US 9,469,038 B2
(45) Date of Patent: Oct. 18, 2016

(54) WET SHAVER

(75) Inventors: Luca Iaccarino, Groningen (NL); Dimitrios Efthimiadis, Nea Kypseli-Athens (GR); Panagiotis Zafiropoulos, Nea Philothei-Athens (GR)

(73) Assignee: BIC-VIOLEX SA, Attiki (GR)

( * ) Notice: Subject to any disclaimer, the term of this patent is extended or adjusted under 35 U.S.C. 154(b) by 0 days.

(21) Appl. No.: 13/387,762

(22) PCT Filed: Jul. 31, 2009

(86) PCT No.: PCT/EP2009/059974
§ 371 (c)(1),
(2), (4) Date: Jan. 30, 2012

(87) PCT Pub. No.: WO2011/012172
PCT Pub. Date: Feb. 3, 2011

(65) Prior Publication Data
US 2012/0124840 A1 May 24, 2012

(51) Int. Cl.
*B26B 21/00* (2006.01)
*B26B 21/14* (2006.01)
*B26B 21/22* (2006.01)
*B26B 21/52* (2006.01)

(52) U.S. Cl.
CPC ..... *B26B 21/225* (2013.01); *B26B 21/521* (2013.01)

(58) Field of Classification Search
CPC ..... B26B 21/225; B26B 21/521
USPC ..... 30/57, 49, 50, 58
See application file for complete search history.

(56) References Cited

U.S. PATENT DOCUMENTS

| | | | | |
|---|---|---|---|---|
| 4,715,120 | A * | 12/1987 | McGready | 30/57 |
| 4,756,082 | A * | 7/1988 | Apprille, Jr. | 30/530 |
| 4,785,534 | A | 11/1988 | Lazarchik | |
| 6,138,361 | A | 10/2000 | Richard et al. | |
| 6,276,062 | B1 * | 8/2001 | Prochaska | 30/50 |
| 6,311,400 | B1 * | 11/2001 | Hawes et al. | 30/527 |
| 7,131,203 | B2 * | 11/2006 | Wain | 30/57 |
| 7,526,869 | B2 | 5/2009 | Blatter et al. | |
| 8,191,263 | B2 * | 6/2012 | Follo et al. | 30/41 |
| 8,590,162 | B2 * | 11/2013 | Park et al. | 30/50 |
| 2004/0020053 | A1 * | 2/2004 | Wain | 30/50 |
| 2007/0137045 | A1 | 6/2007 | Follo et al. | |
| 2009/0193659 | A1 | 8/2009 | Park et al. | |

FOREIGN PATENT DOCUMENTS

| | | | |
|---|---|---|---|
| EP | 1 046 472 | A1 | 10/2000 |
| GB | 2 030 909 | A | 4/1980 |
| WO | WO 2008/002069 | A1 | 1/2008 |

OTHER PUBLICATIONS

International Search Report (PCT/EP2009/059974).

* cited by examiner

*Primary Examiner* — Omar Flores Sanchez
(74) *Attorney, Agent, or Firm* — Polsinelli PC

(57) ABSTRACT

A wet shaver that includes a handle, a shaving head having at least two blades, defining a shaving plane (P), the shaving head having a cam surface, the shaving head being pivotally mounted on the handle about a pivot axis (X) parallel to the shaving plane, the shaving head having a rest position, a biasing member provided on the handle, adapted to exert a camming action on the cam surface to bias the shaving head toward the rest position.

19 Claims, 4 Drawing Sheets

WET SHAVER

CROSS REFERENCE OF RELATED APPLICATION

This application is a national stage application of International Application No. PCT/EP2009/059974, filed on Jul. 31, the entire contents of this application are incorporated herein by reference.

FIELD OF THE INVENTION

The embodiments of the present invention relate to a wet shaver.

BACKGROUND OF THE INVENTION

More precisely, the embodiments of the present invention relate to a wet shaver that includes:

a handle, a shaving head having at least two blades, defining a shaving plane, the shaving head having a cam surface, the shaving head being pivotally mounted on the handle about a pivot axis parallel to the shaving plane, the shaving head having a rest position, a biasing member provided on the handle, adapted to exert a caroming action on the cam surface to bias the shaving head toward the rest position.

In the known wet shavers of that kind, the cam surface is usually extending at the back of the shaving head, either substantially parallel to the blade plane, or extending along a bulky surface which is detrimental to the rinsing capability.

There is a need to improve the design of wet razors to enhance the rinsing capability of such razors and to simplify the design and the manufacturing.

OBJECTS AND SUMMARY OF THE INVENTION

One objective of the embodiments of the present invention is to propose a wet shaver with a simplified cam surface design and an enhanced rinsing capability.

To this end, the shaver according to the embodiments of the present invention is characterized in that at least a portion of the cam surface is substantially flat and substantially perpendicular to the shaving plane.

Thanks to these dispositions, the middle part of the back of the shaving head can be substantially simplified and the biasing member does not obstruct the back of the shaving head, resulting in an improved rinsing capability.

In various embodiments of the present invention, one may possibly have recourse in addition to one and/or other of the following arrangements:

the cam surface is substantially parallel to the pivot axis;

the biasing member is preloaded when the shaving head is in the rest position; this preload provides a significant biasing force on the rest position abutment in order to improve the perceived quality;

the cam surface belongs to a cam plane that intersects the shaving plane in an intersection location and wherein the intersection location is in front of the blades;

the shaving head has a guard having a contact surface for contacting a user's skin and the intersection location is in the vicinity of the guard contact surface;

the shaving head has a front side provided with the blades and a back side opposite to the front side, wherein the handle is provided with two symmetrically disposed arms each having a shell bearing at the end thereof, the biasing member being disposed between the two arms, and wherein the back side of the shaving head is provided with arcuate bearing surfaces cooperating with the shell bearings;

the arcuate bearing surfaces are provided with at least one radial abutment cooperating with the shell bearing and adapted to form an angular stop position for the pivotal motion of the shaving head about the pivot axis;

the biasing member is an elastic tongue;

the handle comprises a grip portion and a head portion, and wherein the elastic tongue is integral with the handle head portion;

the shaving head has a front side provided with the blades and a back side opposite to the front side, the back side being provided with a middle rib, the cam surface being arranged on a cam member integral the middle rib;

the middle rib has a width along the pivot axis, and the width is comprised between 1.5 mm and 3.5 mm;

the middle rib has a width along the pivot axis, and the width is less than 2 mm; this improves the rinsing capability of the razor.

BRIEF DESCRIPTION OF THE DRAWINGS

Other features and advantages of the embodiments of the invention appear from the following detailed description of one of its embodiments, given by way of non-limiting example, and with reference to the accompanying drawings.

In the drawings:

In the figures, the same references denote identical or similar elements.

FIG. 1 shows a wet shaver, comprising an elongated handle 2 and a shaving head 5, pivotally mounted on the handle 2 about a pivot axis X between a rest position depicted in FIGS. 4 and 5, and an elongated position depicted in FIG. 6.

Figure 1:
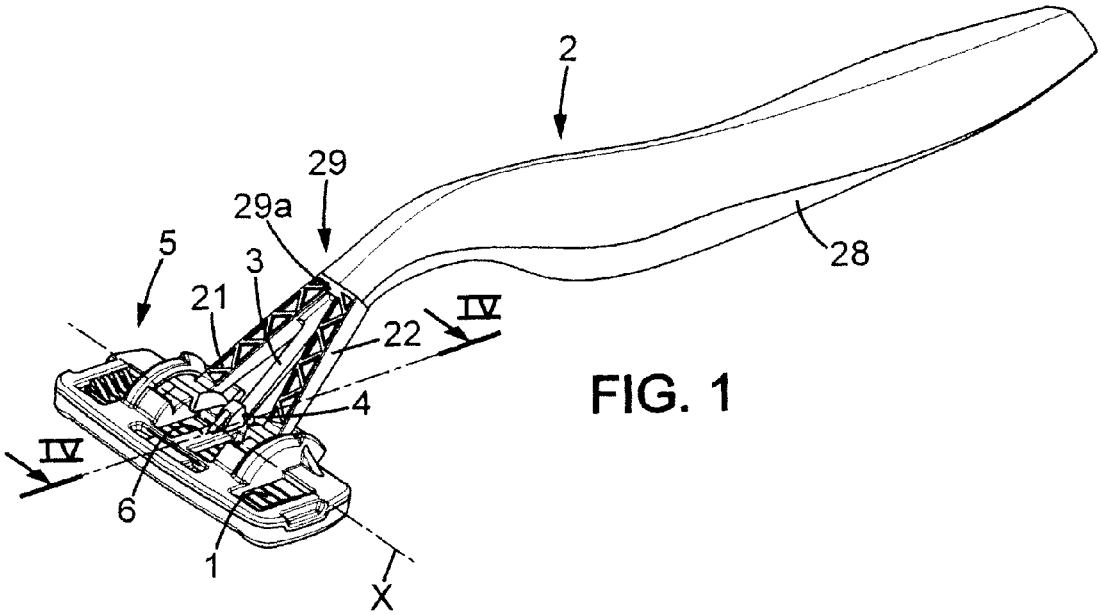
FIG. 1 is a perspective view of a shaver according to an embodiment of the invention.

The handle 2 comprises a grip portion 28 and a head portion 29 on which is attached the shaving head 5. The handle head portion 29 comprises a neck portion 29*a* and two elongated arms 21, 22 extending from the neck portion 29*a* in a direction away from the grip portion 28, and a biasing member 3 which also extends from the neck portion 29*a* in a direction away from the grip portion 28 between the two arms 21.22.

Figure 2:
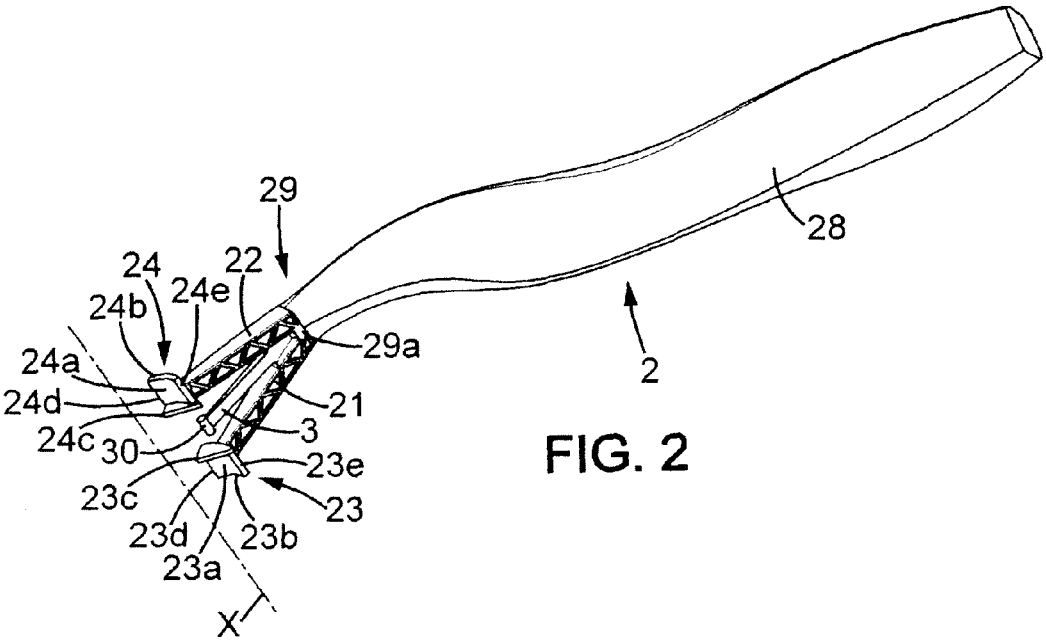
FIG. 2 is perspective view of the handle of the shaver of FIG. 1.

Turning now to FIG. 2, the biasing member 3 is formed as an elastic tongue 3, able to flex in a direction perpendicular to a plane defined by the two arms 21, 22, the elastic tongue 3 terminates in a substantially cylindrical pushing flange 30.

Each arm 21, 22 comprises at its free end a shell bearing 23, 24. Both shell bearings 23, 24 form a pivotal receiving structure to receive complementary interface structure 80, 81 having bearing surfaces 53, 54 and belonging to the shaving head 5 that will be described later.

The first shell bearing 23 comprises an arcuate portion 23*a*, formed as a part of a cylinder centered on the pivot axis X, the arcuate portion 23*a* extending along the pivot axis X outwardly relative to the free end of the corresponding arm 21 and terminated by the outward tip 23*b*, and a transversal stop portion 23*c* extending in a plane perpendicular to the pivot axis X, inwardly relative to the free end of the corresponding arm 21.

The arcuate portion 23*a* is delimited along the longitudinal extension of the razor by a front edge 23*d* and a rear edge 23*e*, both parallel to the pivot axis X.

The second shell bearing 24 is provided on the corresponding arm 22 with a symmetrical design relative to the biasing member 3, it comprises an arcuate portion 24*a*, formed as a part of a cylinder centered on the pivot axis X, the arcuate portion 24*a* extending along the pivot axis X outwardly relative to the free end of the corresponding arm 22 and terminated by the outward tip 24*b*, and a transversal stop portion 24*c* extending in a plane perpendicular to the pivot axis X, inwardly relative to the free end of the corresponding arm 22.

The arcuate portion 24*a* is delimited along the longitudinal extension of the razor by a front edge 24*d* and a rear edge 24*e*, both parallel to the pivot axis X.

Preferably, according to an embodiment of the invention, the grip portion 28, the neck portion 29*a*, the two arms 21, 22 and the biasing member 3 are integrally formed in a single part, which is obtained by molding a synthetic resin.

Turning now to FIGS. 3, 4, 5 and 6, the shaving head 5 comprises a front side 51 on which extend the cutting edges 1*a* of blades 1 and a back side 52 opposite to the front side 51, comprising the interface structures 80, 81 with bearing surfaces 53, 54 for connecting the shell bearings 23, 24 of the handle 2.

There are provided four blades 1 in the example illustrated, although any number greater than two blades is considered within the scope of the embodiments of the present invention.

Figure 5:
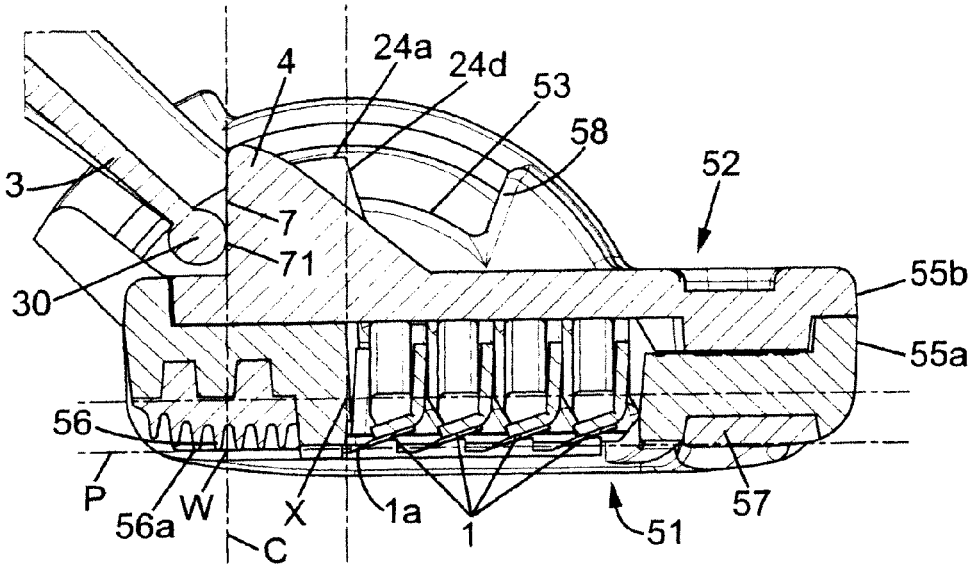
FIG. 5 is a sectional view of the shaver of FIG. 1 with the shaving head in a rest position.

The two or more blades define a shaving plane P, shown in particular on FIG. 5, the pivot axis X being parallel to the shaving plane P.

Furthermore, the front side 51 is also provided with a guard member 56 which extends forward of the cutting edges 1*a* of the blades 1 in the direction of shaving, and a cap member 57 which extends rearward of the cutting edges 1*a* of the blades 1 in the direction of shaving. The guard member 56 has a contact surface 56*a* intended to come into contact with a user's skin.

Figure 3:
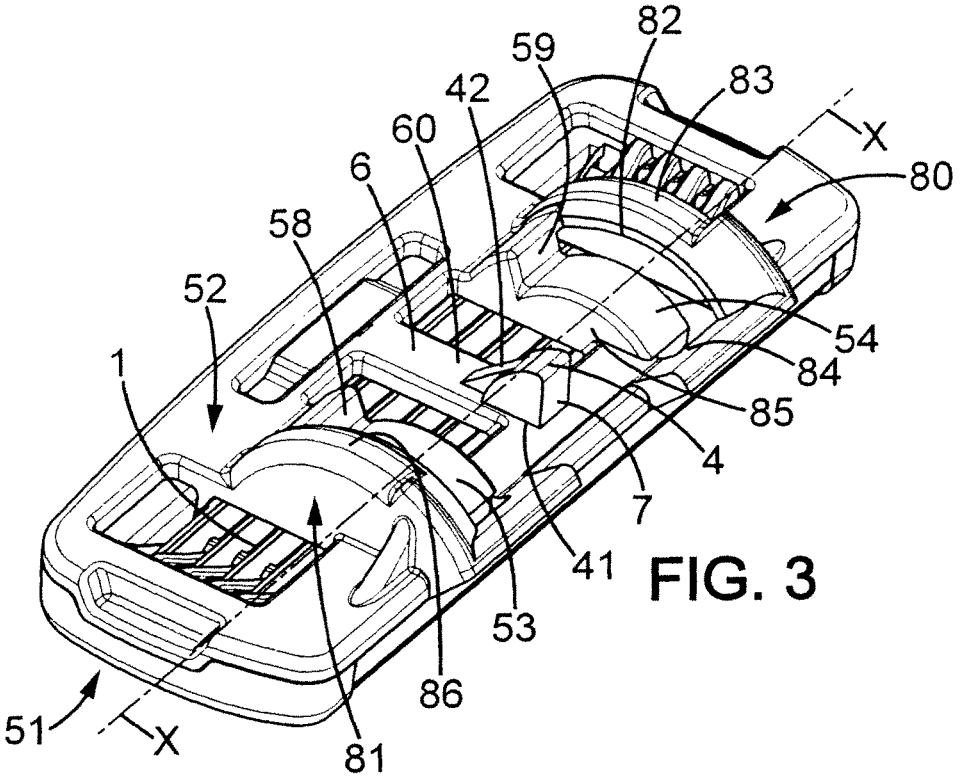
FIG. 3 is a perspective view of the shaving head of the shaver of FIG. 1.

Furthermore, as shown in FIG. 3, the first interface structure 80 comprises an arcuate rib 83 extending perpendicular to the pivot axis X and having an arcuate slot 82 in which is received the outward tip 23*b* of the arcuate portion 23*a* of the first shell bearing 23.

Furthermore, the first interface structure 80 comprises an arcuate bearing surface 54 which is complementary to the arcuate portion 23*a* of the first shell bearing 23, and a rear abutment or a rest position abutment 84 on which is abutting the rear edge 23*e* of the shell bearing 23 to prevent movement of the shaving head 5 beyond the rest position abutment 84, thereby allowing movement of the shaving head 5 on only one side of the rest position abutment 84, that is, "mono-directional movement."

The second interface structure 81 is symmetrically designed compare to the first interface structure 80 and comprises an arcuate rib 86 extending perpendicular to the pivot axis X and a arcuate slot to receive the outward tip 24*b* of the arcuate portion 24*a* of the second shell bearing 24.

The second interface structure 81 also comprises an arcuate bearing surface 53 which is complementary to the arcuate portion 24*a* of the second shell bearing 24, and a rest position abutment on which is abutting the rear edge 24*e* of the shell bearing 24.

Each of the bearing surfaces 53, 54 of the interface structures 80, 81 comprises an elongate position abutment or a front abutment 58, 59, having a surface extending radially outwardly from the bearing surfaces 53, 54. As shown on FIGS. 5 and 6, the front abutment 58 is a stop for the front edge 24*d* belonging to the second shell bearing 24, when the shaving head 5 rotates in the direction of the elongated position.

The bearing surface 54 also comprises a side face 85 extending perpendicular to the pivot axis X. on which is received the corresponding surface of the transversal stop portion 23*c* of the first shell bearing 23 described above.

Figure 4:
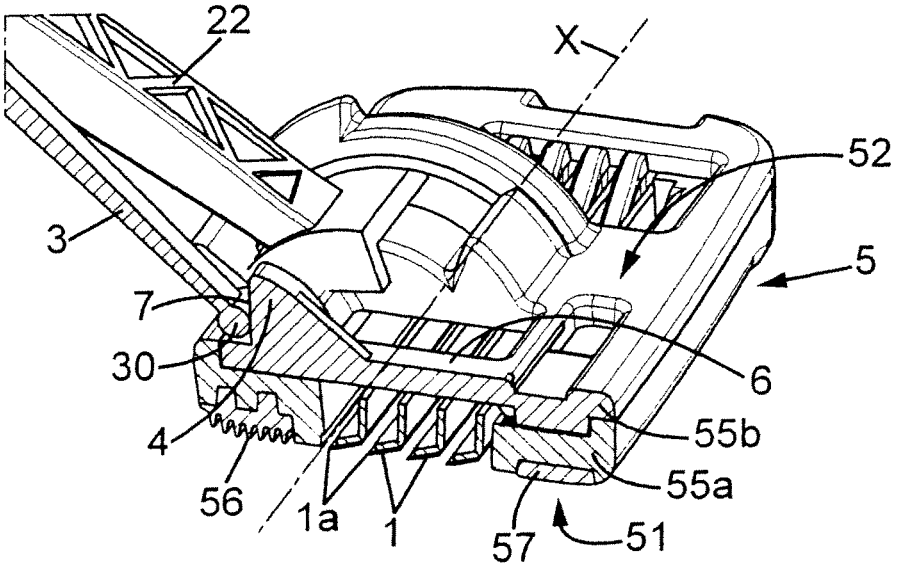
FIG. 4 is a sectional perspective view of the shaver of FIG. 1.

As shown in FIGS. 4 and 5, the shaving head 5 comprises at its front side 51 a front frame 55*a*, on which are provided the guard member 56, the cap member 57 and the blades 1, and comprises at its back side 52 a back frame 55*b* on which are provided the interface structures 80, 81 and all their features described above.

Furthermore, the back frame 55*b* also comprises between the interface structures 80, 81 a middle rib 6 extending in a direction perpendicular to the pivot axis X and parallel to the shaving plane P, substantially in the middle of the shaving head back side 52.

On the middle rib 6, in a position generally forward of the blades 1, 'forward' being defined as the direction of shaving, is provided a cam member 4, extending away from the middle rib 6 in a direction opposite to the shaving plane P. It should be noted that the cam member does not stand in the center 60 of the middle rib 6, but rather on the forward end of the middle rib 6.

Consequently, the middle rib 6 can be designed in order to improve the rinsing capability of the wet razor. The middle rib 6 has a width along the pivot axis X, the width may be comprised between 1.5 mm and 3.5 mm. Preferably according to an embodiment of the invention, the width of the middle rib 6 along the pivot axis X is less than 2 mm.

According to a variant of an embodiment of the invention, the center part of the middle rib could be thinner or even completely suppressed.

The cam member 4 comprises a base portion 41, a strengthening rib 42 and a cam surface 7 on which bears the pushing flange 30 of the elastic tongue 3. The cam member 4 is preferably made integral with the back frame 55*b* and the middle rib 6, such a part is obtained by plastic molding known in the art.

The position of the pushing flange 30 on the cam surface 7 changes according to the position of the shaving head 5 between the rest position and the elongated position. In the rest position of the shaving head 5, the pushing flange 30 contact on the cam surface 7 is situated at location 71 (cf. FIG. 5) whereas in the elongated position the pushing flange 30 contact on the cam surface 7 is situated at the location 72 (cf. FIG. 6).

According to the plurality of positions of the shaving head 5, the range of positions of the pushing flange 30 contact on the cam surface extend from position 71 to position 72 along a flat surface, perpendicular to the blade plane P and parallel to the pivot axis X.

The cam surface 7 is substantially flat and extends substantially perpendicular to the shaving plane P and parallel to the pivot axis X. The biasing member 3 is positioned forward of the cam surface, and as a result the biasing member 3 does not obstruct the back side 52 of the shaving head 5. thus enhancing the rinsing capability of the wet razor.

Moreover, the cam surface 7 is very simple to design and no complex surface needs to be designed, implemented and tested.

The cam surface 7 belongs to a cam plane C, as shown in FIG. 5, and this cam plane C intersects the shaving plane P at an intersection location W, formed as a line W parallel to the pivot axis X. the intersection location W being positioned forward of the blades 1.

Preferably according to an embodiment of the invention, the intersection location W is in the immediate vicinity or contiguous with the contact surface 56*a* of the guard member 56. Preferably according to an embodiment of the invention, the intersection location W is located close to the centerline of the contact surface 56*a* of the guard member 56, as shown in FIG. 5.

Figure 7:
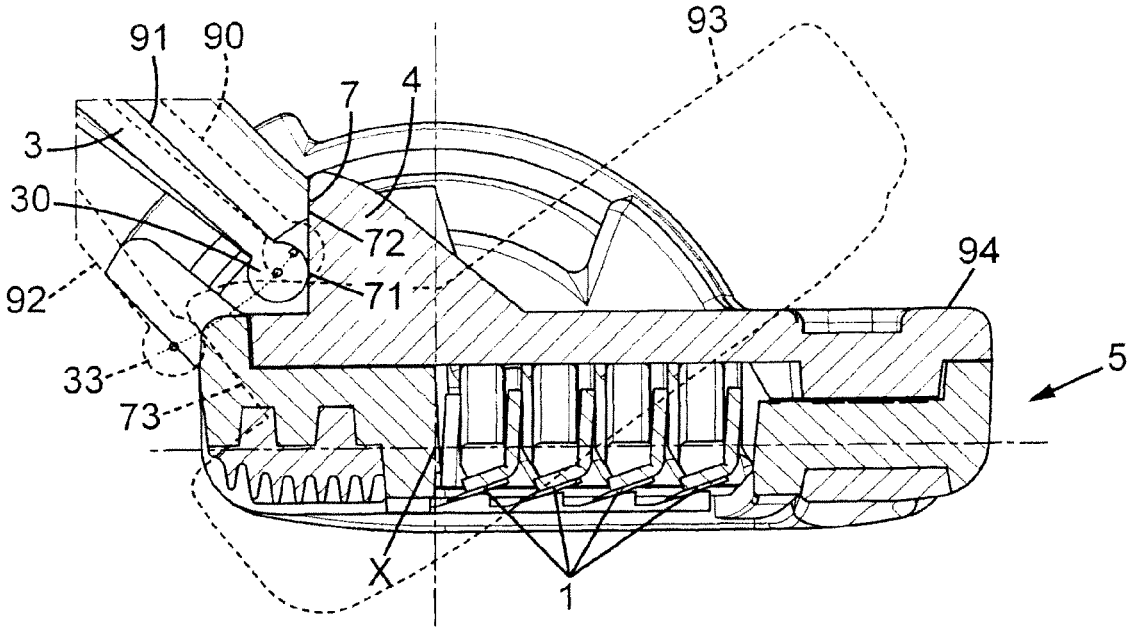
FIG. 7 is a diagrammatic view of the shaver of FIG. 1 showing the range of positions of the biasing member.

As shown in FIG. 7, the biasing member 3 has a free position 90 which is different from the rest position 91 corresponding to the rest position 94 of the shaving head 5. As a result, the biasing member 3 exerts a preload biasing force in the rest position of the shaving head 5, and this preload provides a significant biasing force on the rest position abutment in order to improve the perceived quality.

Figure 6:
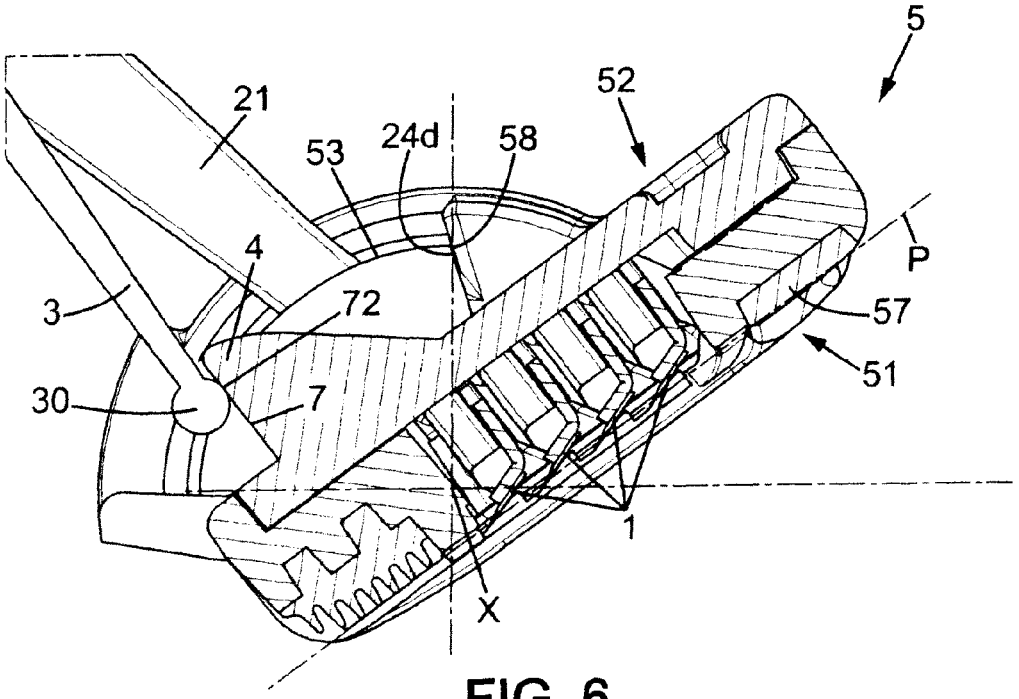
FIG. 6 is a sectional view of the shaver of FIG. 1 with the shaving head in an extended position.

The maximum extended position 92, 33 of the biasing member 3 and its pushing flange 30, shown in doted lines in FIG. 7, corresponds to maximum elongated position 93 of the shaving head 5, also shown in doted lines, in which the abutment 58 is against the front edge 24*d* of the shell bearing 24 (cf. FIG. 6). In this maximum elongated position 93 of the shaving head 5, the cam surface 7 is at location 73 as shown in FIG. 7.

The particular design of the elastic tongue 3, with a long and rather thin body allows a big range of positions between the free position 90 and the maximum extended position 92, with no loss of flexibility and elasticity over time and along the life time of the razor.

We claim:

1. A wet shaver comprising:

a handle, a shaving head (i) having at least two blades, (ii) defining a shaving plane, (iii) having a cam surface, (iv) being pivotally mounted on the handle about a pivot axis parallel to the shaving plane, and (v) operable to pivot between a rest position and a maximum elongated position, and a biasing member (i) provided on the handle, (ii) adapted to exert a camming action on the cam surface to bias the shaving head toward the rest position and against a rest position abutment, thus forming a mono-directional pivoting razor allowing movement of the shaving head between the rest position and the maximum elongated position, wherein at least a portion of the cam surface is substantially flat and substantially perpendicular to the shaving plane, wherein the cam surface coincides with a cam plane that intersects the shaving plane at an intersection location, and wherein the intersection location is in front of the blades.

2. The wet shaver according to claim 1, wherein the cam surface is substantially parallel to the pivot axis.

3. The wet shaver according to claim 1, wherein the biasing member is preloaded when the shaving head is in the rest position.

4. The wet shaver according to claim 1, wherein the shaving head has a guard having a contact surface for contacting a user's skin and the intersection location is in the vicinity of the guard contact surface.

5. The wet shaver according to claim 1, wherein the shaving head has a front side provided with the blades and a back side opposite to the front side, wherein the handle is provided with two symmetrically disposed arms each having a shell bearing at the end thereof, the biasing member being disposed between the two arms, and wherein the back side of the shaving head is provided with arcuate bearing surfaces cooperating with the shell bearings.

6. The wet shaver according to claim 5, wherein the arcuate bearing surfaces are provided with at least one radial abutment cooperating with the shell bearing and adapted to form an angular stop position for the pivotal motion of the shaving head about the pivot axis.

7. The wet shaver according to claim 1, and wherein the biasing member is an elastic tongue.

8. The wet shaver according to claim 7, wherein the handle comprises a grip portion and a head portion, and wherein the elastic tongue is integral with the handle head portion.

9. The wet shaver according to claim 1, wherein the shaving head has a front side provided with the blades and a back side opposite to the front side, the back side being provided with a middle rib, the cam surface being arranged on a cam member integral the middle rib.

10. The wet shaver according to claim 9, wherein the middle rib has a width along the pivot axis, and the width is between 1.5 mm and 3.5 mm.

11. The wet shaver according to claim 9, wherein the middle rib has a width along the pivot axis, and the width is less than 2 mm.

12. The wet shaver according to claim 1, wherein the maximum elongated position is defined by an elongate position abutment.

13. The wet shaver according to claim 1, wherein the maximum elongated position is defined by a plurality of elongate position abutments.

14. A wet shaver comprising:

a handle;

a shaving head (i) having at least two blades, (ii) defining a shaving plane, (iii) having a cam surface, (iv) being pivotally mounted on the handle about a pivot axis parallel to the shaving plane, and (v) having a rest position; and a biasing member (i) provided on the handle, and (ii) adapted to exert a camming action on the cam surface to bias the shaving head toward the rest position, wherein at least a portion of the cam surface is substantially flat and substantially perpendicular to the shaving plane, wherein the cam surface coincides with a cam plane that intersects the shaving plane at an intersection location, wherein the shaving head has a guard with a contact surface operable to contact a user's skin, and wherein the intersection location is in front of the at least two blades and in a vicinity of the guard contact surface.

15. The wet shaver according to claim 1, wherein the rest position is defined by a rest position abutment, wherein the shaving head is operable to pivot between the rest position and an elongated position, wherein the rest position is defined by at least one rest position abutment, wherein the elongated position is defined by at least one elongated position abutment.

16. A wet shaver comprising:

a handle;

a shaving head (i) having at least two blades, (ii) defining a shaving plane, (iii) having a cam surface, (iv) being pivotally mounted on the handle about a pivot axis parallel to the shaving plane, and (v) having a rest position; and a biasing member (i) provided on the handle, and (ii) adapted to exert a camming action on the cam surface to bias the shaving head toward the rest position, wherein at least a portion of the cam surface is substantially flat and substantially perpendicular to the shaving plane, wherein the cam surface coincides with a cam plane that intersects the shaving plane at an intersection location, wherein the intersection location is in front of the at least two blades, wherein the shaving head has a front side provided with the at least two blades and a back side opposite to the front side, and wherein the back side has a middle rib and the cam surface is arranged on a cam member integral to the middle rib.

17. The wet shaver according to claim 16, wherein the middle rib has a width along the pivot axis, and the width is between 1.5 mm and 3.5 mm.

18. The wet shaver according to claim 16, wherein the middle rib has a width along the pivot axis, and the width is less than 2 mm.

19. The wet shaver according to claim 16, wherein the rest position is defined by a rest position abutment, wherein the shaving head is operable to pivot between the rest position and an elongated position, wherein the rest position is defined by at least one rest position abutment, wherein the elongated position is defined by at least one elongated position abutment.

* * * * *